United States Patent [19]

Yanagi et al.

[11] Patent Number: 4,644,667

[45] Date of Patent: Feb. 24, 1987

[54] COOLING APPARATUS FOR STRIP METAL

[75] Inventors: Kenichi Yanagi; Katsumi Makihara; Takeo Fukushima, all of Hiroshima; Osamu Hashimoto, Chiba; Sachihiro Iida, Kurashiki, all of Japan

[73] Assignees: Mitsubishi Jukogyo Kabushika Kaisha, Tokyo; Kawasaki Steel Corporation, Hyogo, both of Japan

[21] Appl. No.: 696,242

[22] Filed: Jan. 29, 1985

[30] Foreign Application Priority Data

Feb. 14, 1984 [JP] Japan ..... 59-24414

[51] Int. Cl.[4] ..... F26B 7/00

[52] U.S. Cl. ..... 34/54; 34/114; 266/81; 266/87; 266/90; 266/259

[58] Field of Search ..... 266/259, 81, 87, 90, 266/111; 34/54, 114, 62

[56] References Cited

U.S. PATENT DOCUMENTS

| | | | |
|---|---|---|---|
| 2,521,044 | 9/1950 | Cooper et al. | 266/111 |
| 3,089,252 | 5/1963 | Daane et al. | 34/114 |
| 3,116,788 | 1/1964 | Beggs et al. | 266/111 |
| 3,161,482 | 12/1964 | Gschwind et al. | 34/54 |

*Primary Examiner*—Larry I. Schwartz

*Attorney, Agent, or Firm*—Wenderoth, Lind & Ponack

[57] ABSTRACT

The invention concerns cooling apparatus for strip metal of the kind comprising a series of spaced cooling rolls around which the strip metal is passed such that it follows a serpentine path and is cooled by contact with the rolls, and elongate gas jet devices disposed widthwise of the strip opposite the outer surface parts of respective cooling rolls in contact with the strip. The invention is characterized in that each said gas jet device is partitioned into segments in said widthwise direction, in that each segment is provided with a gas flow control valve, in that means are provided at least at one cooling roll position for detecting strip temperature across its width, and in that strip temperature control and arithmetic means are provided to which the gas flow valves and the temperature detecting means are electrically connected, the arrangement being such that the temperature difference between the average temperature across the strip and the temperature of the strip at each segment width position can be compared, via electrical signals from the temperature detecting means and, if the temperature difference at a widthwise position is above or below predetermined limits, the corresponding gas flow control valves are adjusted to bring the temperature within the predetermined limits.

6 Claims, 10 Drawing Figures

COOLING APPARATUS FOR STRIP METAL

The present invention relates to cooling apparatus for strip metal, such as steel plates, in a continuous annealing line, or in a galvanizing line and, more particularly, to apparatus that directs cooling gas on to the strip metal as it passes from location to location to maintain the strip at a substantially uniform temperature.

BACKGROUND OF THE INVENTION

Referring to FIG. 1, a conventional method of cooling strip metal in a continuous annealing furnace is shown. The strip metal 1 is sequentially wound partially around a series of spaced cooling rolls 2 in such a way that the strip follows a serpentine path, and is cooled over the areas where it contacts the rolls 2. This method has great advantages. Firstly, it poses no problems about the shape of the surface of the strip 1. Secondly, the strip can be processed in an economical manner. However, it is likely that the standard shape of the strip 1 will be deformed, depending upon the manner in which it contacts with the cooling rolls 2. Specifically, strip metal cooled in this way usually shows a center buckle, or edge wave, of the irder of 0.1%. Therefore, some portions of the strip make good contact with cooling rolls and are rapidly cooled, while the others make poor contact with them. This creates an uneven temperature distribution across the width of the strip. As a result, thermal stresses are produced, deforming the strip from its standard shape.

In an attempt to reduce the possibility of deformation of the strip metal, apparatus as shown in FIG. 2 has been proposed. In this apparatus, gas jet devices 3 are disposed opposite the peripheral parts of the cooling rolls 2 in contact with the strip 1. Each gas jet device 3 blows cooling gas onto the strip 1, uniformly across the width of the strip, to heat-treat it and thereby reduce the possibility of the strip being deformed out of standard.

The apparatus of FIG. 2 blows cooling gas onto the strip 1 uniformly in the widthwise direction whether or not the temperature distribution is uniform, and irrespective of the degree of non-uniformity. This renders the temperature distribution more uniform than the case where cooling gas is not blown. However, it will be appreciated that edge portions of the strip at higher temperatures are not cooled more. Hence, the temperature distribution widthwise of the strip still cannot be made sufficiently uniform. Further, the continuous and uniform blowing of cooling gas increases the electric power consumed by the apparatus. This is especially undesirable, in that the cost of production is increased and yet there is still an insufficient uniformity of the temperature distribution.

SUMMARY OF THE INVENTION

In view of the foregoing difficulties, it is the main object of the present invention to provide cooling apparatus for strip metal which enables the temperature distribution widthwise of the strip to be made sufficiently uniform to prevent it from being deformed, and which is cpable of cooling the strip efficiently.

According to the invention, cooling apparatus for strip metal, of the kind comprising a series of spaced cooling rolls around which the strip metal is passed such that it follows a serpentine path, to cool it through the contact with the rolls, and elongate gas jet devices disposed widthwise of the strip opposite to the outer surface parts of respective cooling rolls in contact with the strip, is characterised in that each said gas jet device is partitioned into segments in said widthwise direction, in that each segment is provided with a gas flow control valve, in that means are provided at least at one cooling roll position for detecting strip temperature across its width, and in that strip temperature control and arithmetic means are provided to which the gas flow valves and the temperature detecting means are electrically connected, the arrangement being such that the temperature difference between the average temperature over the complete width of the strip and the temperature of the strip at each segment width position can be compared, based on signals indicative of temperatures delivered from the temperature detecting means and if the temperature difference at any widthwise position is above or below predetermined limits, the gas flow control valves corresponding to those widthwise positions are appropriately controlled to bring the temperature within said predetrmined limits

BRIEF DESCRIPTION OF THE DRAWINGS

In order that the invention may be readily understood, and further features made apparent, various embodiments thereof will now be described, by way of example, with reference to the accompanying drawings, in which.

DETAILED DESCRIPTION OF THE INVENTION

Figure 1:
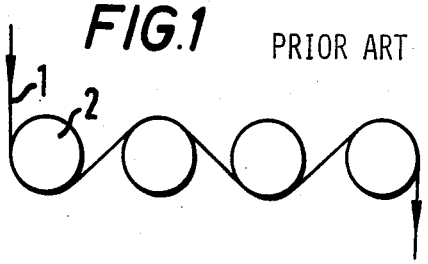
FIG.1 PRIOR ART
FIG. 1 is a schematic view of one conventional cooling apparatus for strip metal, showing the arrangement of the cooling rolls.
Figure 2:
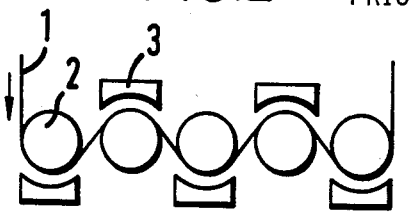
FIG.2 PRIOR ART
FIG. 2 is a schematic view of another conventional cooling apparatus having gas jet devices.

The present invention is hereinafter described in detail with reference to FIGS. 3 to 10, in which parts equivalent to those already described above with reference to FIGS. 1 and 2 are indicated by the same reference numerals.

Figure 3:
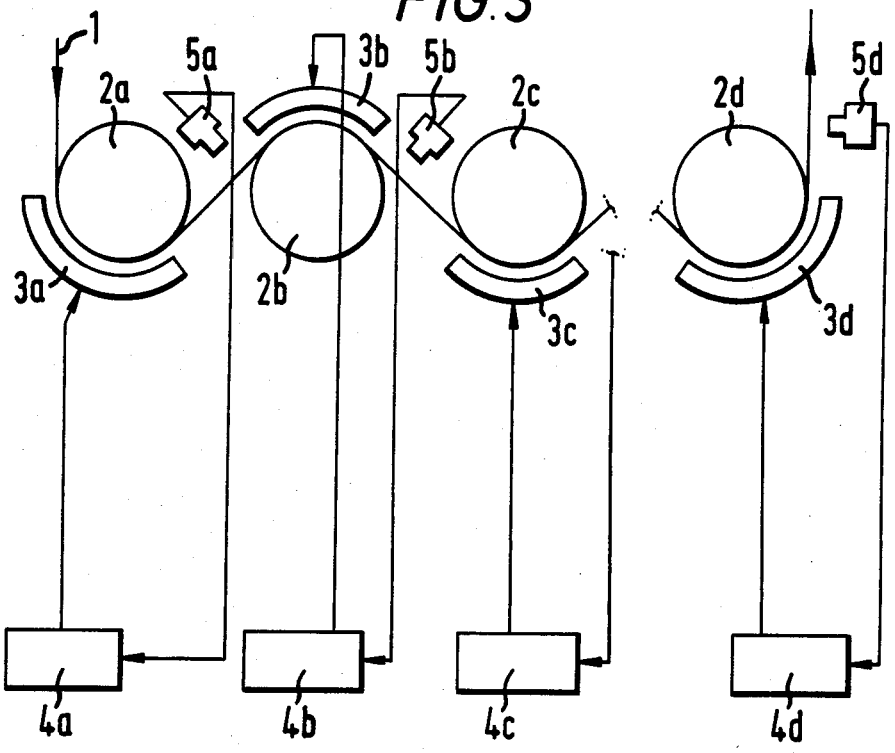
FIG. 3 is a schematic view of one embodiment of a cooling apparatus for strip metal according to the present invention.
Figure 4:
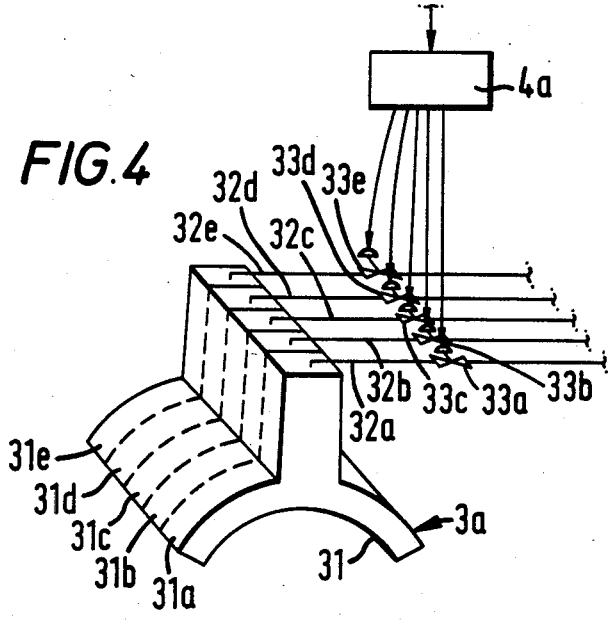
FIG. 4 is a perspective view of one preferred form of gas jet device for use in a cooling apparatus according to the invention.

Referring to the embodiment shown in FIG. 3, strip metal 1 is partially wound around a plurality of spaced cooling roll 2*a*–2*d* in such a way that the strip follows a serpentine path. Each of the cooling rolls has a cooling mechanism therein. Gas jet devices 3*a*–3*d* are disposed opposite to those outer surface parts of respective rolls 2a–2d, in contact with the strip 1. Referring also to FIG. 4, each of these gas jet devices 3a–3d is of elongate form, extends across the width of the strip 1, and comprises a chamber 31 that is laterally partitioned into a number (e.g. five) of segments 31a–31e. Gas supply ducts 32a–32e communicate with respective segments 31a–31e, and respective gas flow control valves 33a–33e are installed in the ducts 32a–32e, said valves being normally closed. All the flow control valves 33a–33e of each supply duct 32a–32e are electrically connected to a respective temperature control and arithmetic unit 4a–4d, and said valves are arranged to be selectively opened under the instruction of their respective unit if the temperature at any segment width position of the strip 1 exceeds or falls below prescribed limits as described later.

Disposed at the exit side of the rolls 2a–2d are respective temperature detecting means in the form of four thermometers 5a–5d, including the three thermometers 5a, 5b and 5d shown in FIG. 3, (5c is not shown in FIG. 4) for measuring the temperature distribution across the width of the strip 1. The output terminals of the thermometers 5a–5d are connected to their respective temperature control and arithmetic units 4a–4d so that electrical signals indicating temperatures may be fed to these units. The arithmetic units 4a–4d arithmetically process the signals to control the flow control valves 33a–33e. Each thermometer can be arranged either in one set position and rotated so as to traverse across the width of the strip, or can be moved laterally so as to traverse across the strip.

In the structure constructed as described above, the strip 1 introduced into the control apparatus is passed sequentially through the spaced rolls 2a and 2d in a serpentine path. During its passage, the strip is cooled by contact with the rolls. The thermometers 5i a–5d continuously sense temperatures at widthwise positions across the strip 1, and the resultant signals indicating these temperatures are fed to their respective temperature control and arithmetic units 4a–4d, e.g., the unit 4b receives the signal from the thermometer 5b. The arithmetic units 4a–4d then arithmetically find the average temperature T across the width of the strip. Further, the units 4a–4d calculate the difference ΔT between the average temperature T and the temperature at each width position. If any temperature difference ΔT differs from a prescribed range, then the corresponding one or more of the flow control valves 33a–33e connected to the segments of the gas jet device 3b is or are adjusted to adjust the flow of cooling gas to the respective width part(s) of the strip so as to maintain the temperature difference ΔT within the prescribed range across the width of the strip. Thus, if the temperature difference ΔT exceeds the prescribed range in a positive direction, i.e., the temperature at a widthwise position is higher than a prescribed upper limit, then the corresponding flow control valve is opened for cooling the strip. On the other hand, if the difference ΔT exceeds the range in a negative direction, i.e., the temperature at a widthwise position is lower than a prescribed lower limit, when a check is performed to see whether the corresponding valve is closed or open. If it is open, then the valve is so controlled as to limit the flow of cooling gas. If it is closed, other valves are opened as appropriate to hold down the temperature difference ΔT below the limit.

The gas jet devices 3a–3d are controlled according to the signals indicating the temperatures at positions lying on the exit side of the rolls 2a–2d, as shown in FIG. 3, which are opposite to and in front of the respective gas jet deices. Thus, the gas jet device 3a is controlled by the signal delivered from the thermometer 5a. In the same manner, the gas jet devices 3b and 3d are controlled by the thermometers 5b and 5d, respectively.

It will be appreciated here that if the temperature at the entrance of a roll were to be detected, and the gas jet device lying immediately behind controlled according to the resulting signal, if any temperature difference ΔT was beyond the limit, the difference ΔT could not be reduced since this is the point at which the strip begins to contact the roll. Therefore, it would be impossible to prevent the strip from being deformed out of standard.

Figure 5:
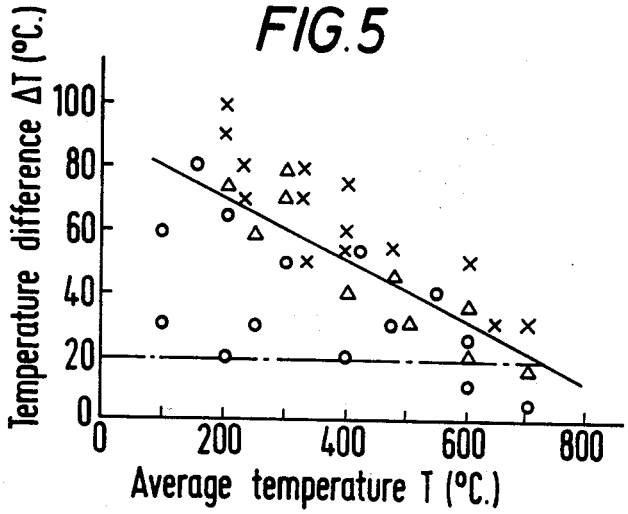
FIG. 5 is a graph showing the relationship between temperature difference $\Delta T$ and average temperature T of a strip.

FIG. 5 shows the effect of the relation between the average temperature T over the complete width of the strip and each temperature difference ΔT at positions lying in the widthwise direction of the strip, upon the rate of occurrence of ill-shaped strips. In FIG. 5, strips having a good shape are indicated by o, somewhat ill-shaped strips are indicated by Δ, and strips deformed out of standard are indicated by x. The somewhat ill-shaped strips are those which have small cambers. The strips deformed out of standard are defined here as those having large edge waves or folds in their central portions, or having draw marks. The measurement was made using a number of strip steel plates which have thicknesses ranging from 0.5 mm to 1.2 mm and widths ranging from 800 mm to 1200 mm. These plates were moved along the cooling rolls under a tension of 0.5 to 3.0 $Kg/mm^2$. After completing the cooling process, the average temperature T of each strip and the temperature difference ΔT at width positions of each strip were measured. The shape of each strip was observed by the eye.

The result of the above-described measurement shows that the rate of occurrence of ill-shaped strips is not materially affected by the thickness or width of the strip, or the tension, but rather it can be readily forecasted by the relation of the temperature difference ΔT at each width position compared with the average temperature T of the strip, as can be seen from FIG. 5.

In addition to the cooling processing as described previously, the strips were heat-treated by the rolls until the temperature of each strip reached about 400° C. Ill-shaped strips occurred at substantially the same rate as in the case of the cooling processing.

Referring again to FIG. 5, as the average temperature T of each strip is increased, ill-shaped strips occur more frequently at smaller values of temperatures difference ΔT. This phenomenon is explained as follows:

Deformation of strips is caused by thermal stresses, which are attributable to non-uniform temperature distribution across the width of each strip. When the thermal stresses exceed the yield stress of the material, the strip is formed elastically. As the temperature is elevated, the yield stress is lowered. Consequently, ill-shaped strips are produced even if the temperature difference assumes a small value.

The region of FIG. 5 in which ill-shaped strips are often produced is bounded by the following inequality:

$$\Delta T > 90 - (1/10) \cdot T$$

In particular, when the temperature difference ΔT is smaller than this boundary line, ill-shaped strips are rarely produced. Inversely, when it is larger than the boundary line, such strips are frequently produced.

Accordingly, the temperature distribution in the lateral extent of the strip must be controlled in such a way that the relation $$\Delta T \leqq 90-(1/10)\cdot T$$

is satisfied. If the temperature is controlled under the condition $$\Delta T > 90-(1/10)\cdot T$$

then it is highly possible that ill-shaped strips have been already produced. Also as can be seen from FIG. 5, if the condition $$\Delta T < 20^\circ \text{ C.}$$

is met, strips are never deformed out of standard irrespective of the average temperature of the strip.

Figure 6:
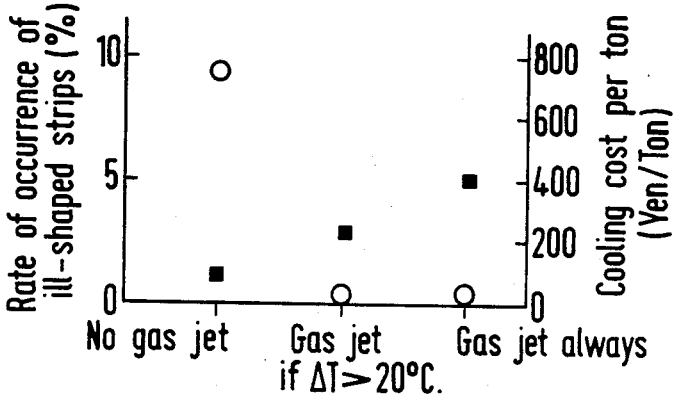
FIG. 6 is a graph showing the relationship between the rate of occurrence of deformed strips to the cost per ton, in relation to various usages of gas jet.

Thus, it is possible to make the temperature distribution on the strip uniform by controlling the gas jet devices after setting the limit for the temperature difference $\Delta T$ such that this difference is placed within the aforementioned region. As a result, the obtained strips are not deformed. The present example, where cooling gas is emitted under the condition $\Delta T > 20^\circ$ C., reduces the cost gretly as compared with the conventional method shown in FIG. 6, where cooling gas is ejected continuously. In FIG. 6, o indicates a rate of occurrence of ill-shaped strips, and indicates a cost needed for cooling per ton. The rates and the costs have been derived for three cases. This is, in a first case, no gas jet is employed. In a second case, gas jet is employed under the condition $\Delta T > 20^\circ$ C. In a third case, gas jet is used at all times.

In the description thus far made, the gas jet devices 3*a*–3*d* are partitioned into segments laterally of the strip, each segment having a respective flow control valve 33*a*–33*e* which is usually closed. Only when the temperature difference $\Delta T$ exceeds the prescribed limit, the corresponding segments are opened by the instruction of the strip temperature control and arithmetic units 4*a*–4*d*. It is also possible to determine the minimum of opening of each valve as the need arises, in which case cooling gas may always be emitted through this minimum opening. The need to blow cooling gas beforehand arises (1) when strips of high temperatures are cooled and (2) when the cooling rate needed to cool strips exceeds the cooling capacity provided only by the cooling rolls. In the case (1) above, the minimum opening of each flow control valve is determined to avoid thermal deformation of the gas jet nozzles. Usually, this opening is maintained. In the case (2), the flow of cooling gas that fulfills the cooling requirement is determined. Usually, the opening is maintained. Now let $\beta$ be the opening that meets the requirements of the cases (1) and (2). This opening $\beta$ is based on the flow of gas that is usually required. The opening of each flow control valve is controlled so that it is equal to or greater than $\beta$.

Figure 7:
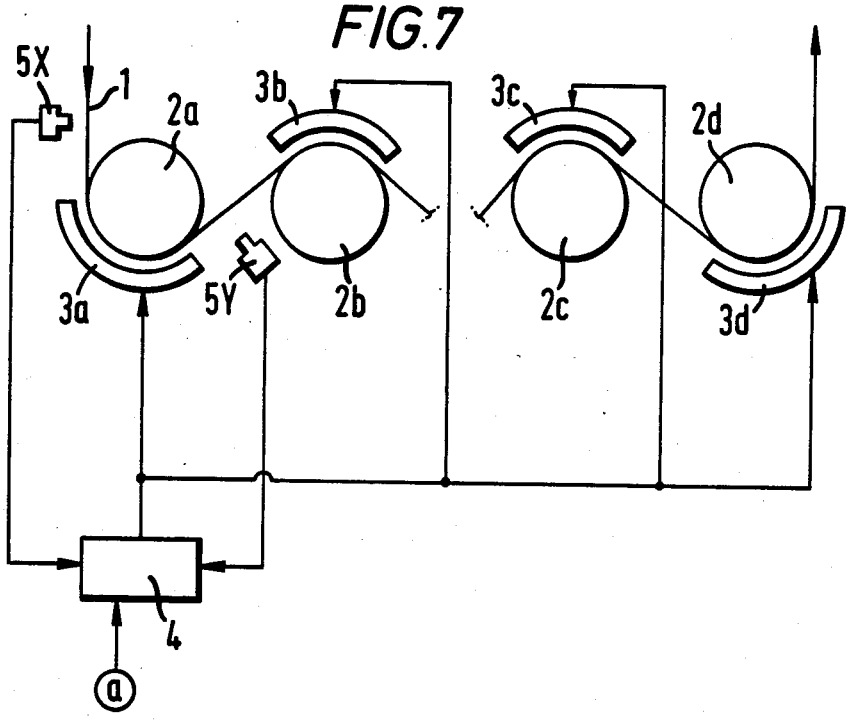
FIG. 7 is a schematic view of another embodiment of the cooling apparatus according to the invention.

In the description thus far made, the thermometers are installed on the exit side of all the rolls 2*a*–2*d*. In the example of FIG. 7, only two thermometers 5X and 5Y are installed. The thermometer 5X is placed on the entrance side of the first roll 2*a*, while the thermometer 5Y is arranged on the exit side of the first roll 2*a*. Gas jet devices 3*a*, 3*b*, 3*c*, and 3*d* are exactly the same as those shown in FIG. 4. Each of these jet devices is partitioned into segments widthwise of the strip. Each segment is provided with a flow control valve whose opening is controlled by a strip temperature control and arithmetic unit 4. Usually the valve is maintained fully closed.

The strip 1 is moved along the spaced rolls 2*a*–2*d* in turn following a serpentine path. The portions of the strip which make contact with the rolls are cooled. Thermometers 5X and 5Y traverse and thus sense the temperature distribution across the width of the strip 1 at all times, and they supply signals indicative of temperatures to the control and arithmetic unit 4, which calculates average temperatures $T_A$ and $T_B$ at positions A and B, respectively, of the strip and the difference $\Delta T_B$ between the average temperature $T_B$ and the temperature at each point across the width of the strip. If any temperature difference $\Delta T_B$ exceeds a prescribed limit, an instruction is issued so that the flow control valves of corresponding segments may be opened, the opening being determined in the maner described below.

The average heat transfer coefficient $\overline{K}$ (expressed in Kcal/m$^2$h°C.) between a strip and a refrigerant and heat transfer coefficient K (expressed in Kcal/m$^2$h°C.) in portions of high temperatures are given by $$\overline{K} = G\cdot C(T_A - T_B)/A_2\cdot \Delta tm_2$$

$$K = G\cdot C(T_A' - T_B')/A_2\cdot \Delta t'm_2$$

where G is the quantity of processed strip (expressed in Kg/H), C is the specific heat of the strip (expressed in Kcal/Kg°C.), $A_2$ is the area of the portion of the strip which makes contact with a roll, $T_B' = T_B + \Delta T_B$ (temperature in a higher-temperature portion), $T_A'$ is the temperature at position A which lies in the widthwise direction of the strip and corresponds to $T_B'$ and $$\Delta tm_2 = \frac{(T_A - T_{W2}) - (T_B - T_{W2})}{\ln \dfrac{T_A - T_{w2}}{T_B - T_{W2}}}$$

$$\Delta t'm_2 = \frac{(T_A' - T_{W2}) - (T_B' - T_{W2})}{\ln \dfrac{T_A' - T_{W2}}{T_B' - T_{W2}}}$$

where $T_{W2}$ is the temperature of the refrigerant on a roll.

The non-uniformity of the temperature distribution across the width of the strip is principally caused by non-uniform contact of the strip with a cooling roll, the non-uniform contact being attributable to center buckle or edge wave on the strip. Usually, the strip is wound into a coil after being rolled. Each coil is heat-treated at a high or low temperature while being unwound. Hence, the distribution characteristic of a center buckle or edge wave across the width of the strip is uniform, at least for one coil. This was also confirmed during the examination on the shapes shown in FIG. 5. That is, at least for one coil, the position across the width of the strip at which a deformation occurs does not vary. As a result, K and $\overline{K}$ given above are constant from the first to the last roll. Accordingly, the average temperature of a strip extending across a roll and the temperature of the higher-temperature portions which make poor contact with the strip can be estimated.

The average heat quantity $Q_3$ (expressed in Kcal/H) taken away from the rolls shown in FIG. 3 is given by $$Q_3 = G\cdot C(T_B - T_C)$$

where C is measured on the exit side of a roll. The above formula can be changed to $$Q_3=\overline{K}\cdot A_3\cdot \Delta Tm_3$$

ps where $$\Delta tm_3 = \frac{(T_B - T_{W3}) - (T_C - T_{W3})}{\ln \frac{T_B - T_{W3}}{T_C - T_{W3}}}$$

$$= \frac{T_B - T_C}{\ln \frac{T_B - T_{W3}}{T_C - T_{W3}}}$$

$$\text{Thus, } Q_3 = GC(T_B - T_C)$$

$$= \overline{K} \cdot A_3 \frac{T_B - T_c}{\ln \frac{T_B - T_{W3}}{T_C - T_{W3}}}$$

where $T_C$ is the average temperature on the exit side of a roll. Similarly, $Q_3'=G\cdot C(T_B'-T_C')$.

Since $Q_3'=KA_3\cdot \Delta t'm_3$, the temperature $T_C'$ in the higher-temperature portion of a strip on the exit side of a roll can be estimated.

This procedure is repeated up to the final roll to find the average temperature of each strip extending across a roll plus the temperature of the higher-temperature portion which makes poor contact with the roll. Thus, the average heat quantity Q lost by cooling each roll and the heat quantity Q' lost by cooling the portion which makes poor contact with the roll can be derived from these temperatures. Accordingly, uniform cooling can be attained by taking the heat $\Delta Q=Q-Q'$ away from the portion making poor contact by gas jet for each roll.

The cooling capacity of a gas jet device is known to be proportional to the flow gas. That is, $$Q=\alpha\cdot \Delta tmg,$$

$$\alpha\alpha mx^n$$

where $\alpha$ is the heat transfer coefficient of the gas jet device, $\Delta tmg$ is the difference in average temperature between the strip and the gas, x is the flow of the gas, and m and n are constants. The relation of the opening of each flow control valve to the flow of the gas should be found previously.

Referring back to FIG. 7, the strip temperature control and arithmetic unit 4 performs the calculations thus far described. When the temperature difference $\Delta T$ between the average temperature across the width of the strip 1 and the temperature on the exit side of the first roll 2*a* exceeds the prescribed upper limit, the unit 4 issues instructions to the flow control valves corresponding to the locations at which the limit is exceeded, in order to maintain the openings conforming to the results of the calculations for the corresponding ones of all the gas jet devices 3*a*–3*d*. The requisite information (a) including the aforementioned values G, C and $T_W$ is supplied to the control and arithmetic unit 4 as shown in FIG. 7.

If a low temperature not reaching the prescribed lower limit takes place, a flow control valve which has been opened as mentioned previously may be throttled, or a closed valve may be opened appropriately. It is also possible to maintain each gas jet device always to the minimum allowable opening as described already above.

In the example of FIG. 7, two thermometers are disposed at different positions. However, if necessary, a larger number of thermometers may be installed. In this case, temperatures can be controlled with greater accuracy by exerting similar control over the temperatures between the successive thermometers.

Figure 8:
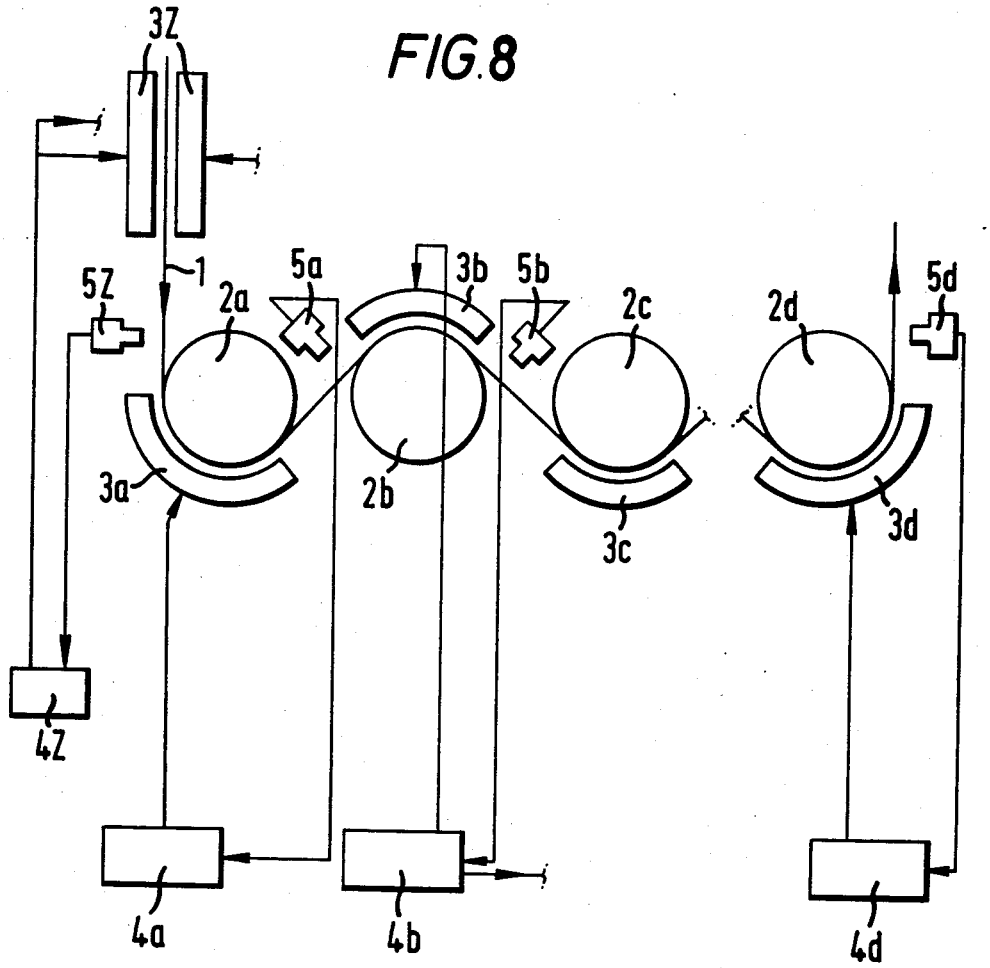
FIG. 8 is a view similar to FIG. 3, but showing a further embodiment of the cooling apparatus according to the invention.

Referring to FIG. 8, there is shown a further example of apparatus which incorporates a thermometer 2Z, a strip temperature control and arithmetic unit 4Z and a gas jet device 3Z in addition to the devices shown in FIG. 3. The thermometer 2Z and the unit 4Z are installed on the entrance side of the first roll 2*a*. The gas jet device 3Z is located on the entrance side of the thermometer 2Z, and is partitioned into segments across the width of the strip. Each segment is provided with a flow control valve.

Figure 9:
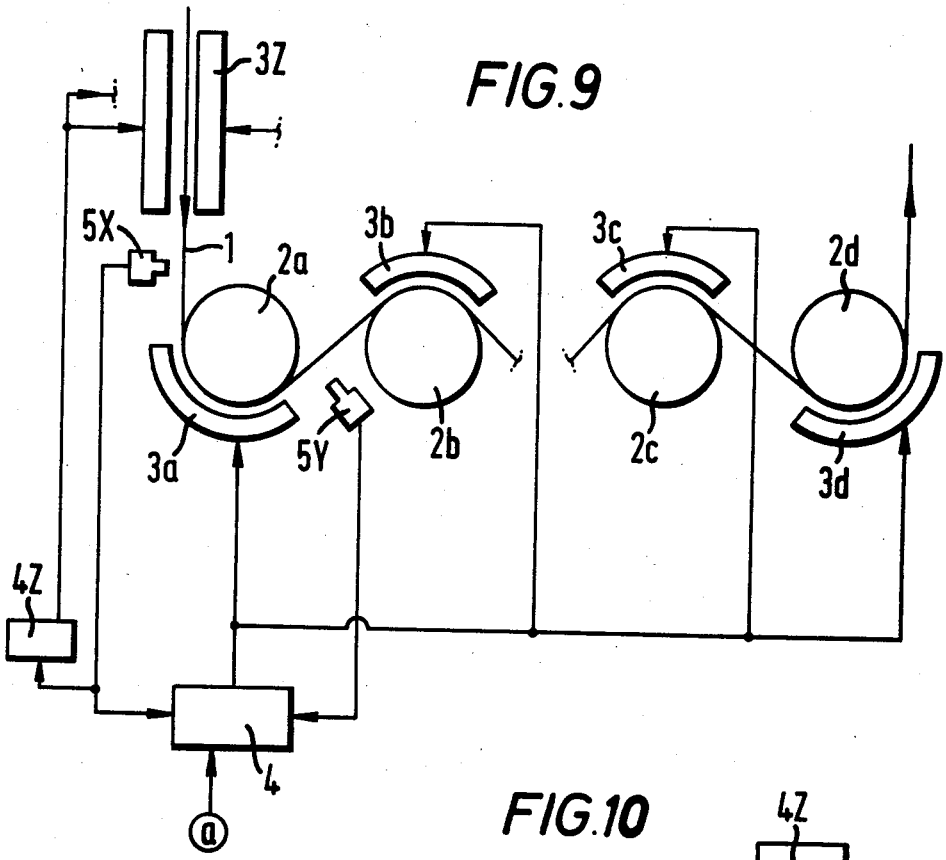
FIG. 9 is a view similar to FIG. 7, but showing yet another embodiment of a cooling apparatus according to the invention.
Figure 10:
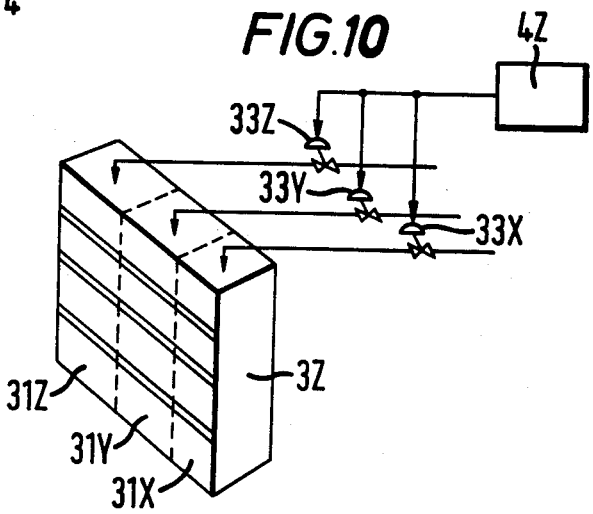
FIG. 10 is a perspective view of another preferred form of gas jet device.

Referring next to FIG. 9, there is shown another example of apparatus, which is essentially the same as the apparatus shown in FIG. 8 except that improvements similar to those in FIG. 7 have been made therein. Specifically, the gas jet device 3Z is partitioned into segments (three segments in FIG. 10) across the width of the strip as shown in FIG. 10. These segments 31X, 31Y, and 31Z are equipped with flow control valves 33X, 33Y, and 33Z, respectively. The opening of each valve is controlled by the instruction of the control and arithmetic unit 4Z or 4*a*.

The examples of apparatus shown in FIGS. 3 and 7 are intended to effectively prevent occurrence of ill-shaped strips due to non-uniform contact of a strip with a roll in a cooling zone. However, if the temperature difference $\Delta T$ at one of the widthwise positions lying in the lateral extent of the strip at the entrance of the cooling zone is in excess of the aforementioned limit, a deformation will take place on the first roll 2*a*. Then, even if gas jet devices are used later, the deformation cannot be prevented. That is, the temperature distribution at the point at which the strip begins to make contact with the first roll cannot be changed. To overcome this difficulty, the gas jet device 3Z is disposed in front of the cooling rolls, as shown in FIGS. 8 and 9, for reducing the temperature difference $\Delta T$ at the entrance of the first roll below the prescribed limit. The detection of the temperature distribution, calculations, control of the control valves regarding the first roll are all performed in the same manner as the foregoing.

It will thus be appreciated that the various embodiments of cooling apparatus described in accordance with the invention use gas jet devices, thermometers, and strip temperature control and arithmetic units to enable a uniform temperature distribution across the width of a strip metal to be effected, thereby preventing such strip from being deformed out of standard. Furthermore, the invention ensures that such metal strip can be effectively and economically cooled.

We claim:

1. An apparatus for cooling a strip of strip metal, comprising a series of spaced cooling rolls around which the strip metal is passed lengthwise such that it follows a serpentine path and is cooled by contact with the rolls; elongate gas jet devices disposed widthwise of the strip opposite the outer surface parts of respective cooling rolls in contact with the strip, each of said gas jet devices being partitioned into segments in said widthwise direction, each segment being provided with a corresponding gas flow control valve; means, provided at at least at one of said cooling rolls, for detecting the temperature of the strip across its width; strip temperature control and arithmetic means to which the gas flow valves and the temperature detecting means are electrically connected, for measuring the temperature difference $\Delta T$ between the average temperature T over the complete width of the strip and the temperature of the strip at each segment width position based on signals indicative of temperatures delivered from the temperature detecting means, and for controlling the corresponding gas flow control valves to bring the temperature difference of the strip at each segment within predetermined limits if the temperature difference at any widthwise position is above or below said predetermined limits.

2. An apparatus as in claim 1, wherein said temperature control and arithmetic means comprises means for controlling the temperature distribution of the strip in the widthwise direction such that the relationship $$\Delta T \leqq 90^\circ \text{ C.} - 1/10T$$

is satisfied, wherein T and $\Delta T$ are given in degrees centegrade.

3. An apparatus as in claim 1, wherein said temperature control and arithmetic means comprises means for controlling the temperature distribution in the widthwise direction of the strip such that the relationship $$\Delta T < 20^\circ \text{ C.}$$

is satisfied.

4. An apparatus as in claim 1, wherein each of the gas flow control valves is normally maintained at a minimum opening.

5. An apparatus as in claim 1, wherein temperature detecting means are provided at the exit sides of each cooling roll.

6. An apparatus as in claim 1, wherein temperature detecting means are provided for the first cooling roll only of the series, said temperature detecting means being disposed on the entrance and exit side, respectively, of said first cooling roll.

* * * * *